US005845903A

United States Patent [19]

Sloan

[11] Patent Number: 5,845,903

[45] Date of Patent: Dec. 8, 1998

[54] GAME OF CHANCE DEVICE

[76] Inventor: Randy Sloan, 3360 Kings Row, Reno, Nev. 89503

[21] Appl. No.: 685,242

[22] Filed: Jul. 18, 1996

[51] Int. Cl.[6] ..... A63F 7/02

[52] U.S. Cl. ..... 273/144 R; 273/108; 273/118 R; 273/142 R; 273/138.1

[58] Field of Search ..... 273/142 R, 138.1, 273/144 R, 144 B, 144 A, 138.2, 138.3, 138.4, 148 R, 118 R, 120 R, 120 A, 121 A, 121 B, 119 A, 108

[56] References Cited

U.S. PATENT DOCUMENTS

| | | |
|---|---|---|
| 2,315,323 | 3/1943 | Fostos . |
| 3,095,655 | 7/1963 | Berglund et al. . |
| 3,304,091 | 2/1967 | Bittner . |
| 3,423,872 | 1/1969 | Dodson . |
| 3,534,964 | 10/1970 | Guill . |
| 3,679,211 | 7/1972 | Hartley . |
| 4,368,887 | 1/1983 | Gamble . |
| 4,385,763 | 5/1983 | Moscovich . |
| 4,508,346 | 4/1985 | Salvucci . |
| 4,754,658 | 7/1988 | Gutknecht . |
| 4,772,024 | 9/1988 | Werner . |
| 4,786,056 | 11/1988 | Dunnigan . |
| 4,796,890 | 1/1989 | Snyder . |
| 4,807,881 | 2/1989 | Jaquez . |
| 4,822,048 | 4/1989 | Axup . |
| 4,824,113 | 4/1989 | Lange . |
| 4,961,578 | 10/1990 | Chateau . |
| 5,050,880 | 9/1991 | Sloan . |
| 5,380,007 | 1/1995 | Travis et al. ..... 273/144 R |
| 5,409,222 | 4/1995 | Egging . |

FOREIGN PATENT DOCUMENTS

| | | |
|---|---|---|
| 3614822 | 5/1987 | Germany . |

*Primary Examiner*—Michael O'Neill
*Attorney, Agent, or Firm*—Thomas M. Freiburger

[57] ABSTRACT

A game of chance based on random distribution of game pieces utilizes a plurality of spheres or discs, which may be generally the size of marbles or checkers, visually divided into two types, such as by two different colors. The game pieces are used in particular to play a bingo-type game. The pieces are contained between two parallel planes spaced apart slightly wider than a game piece, with at least a part of the front plane being transparent. The space between the two planes is circumscribed by a rotatable ring, defining a chamber within which the game pieces remain. With the parallel planes vertical or at least tilted, the lower portion of the chamber is used to randomly mix the game pieces, while at an upper end of the chamber there is located a holding section or display matrix within which the game pieces are all ultimately stored in parallel columns. Rotation of the rotatable ring engages game pieces randomly in notches or recesses of the ring, and they are progressively brought up to the display matrix as rotation continues, ultimately filling all of the columns of the display matrix. The pattern of game pieces reveals whether the player has won a game of chance such as bingo, wherein all pieces of one color would be within a single line. Other patterns can define a win or payout.

15 Claims, 7 Drawing Sheets

GAME OF CHANCE DEVICE

BACKGROUND OF THE INVENTION

This invention is in the field of random selection or distribution devices and machines, and in specific embodiments the invention relates to gaming devices wherein randomness of selection and distribution of an entire population of articles or game pieces is desirable, although fewer than all pieces may be used to show the result of the game.

Particularly in the gaming industry, a great number of random sampling or random motion devices have been known. These include slot machines, roulette wheels, wheels of fortune and other such devices.

Subject matter somewhat closely related to this invention is disclosed in Sloan U.S. Pat. No. 5,050,880, issued Sep. 24, 1991.

U.S. Pat. Nos. 3,095,655, 3,304,091, 3,423,872, 3,534,964, 4,368,887, 4,385,763, 4,508,346, 4,772,024, 4,796,890, 4,807,881, 4,822,048 and 4,824,113 all show various types of games or gaming devices involving skill or chance in moving small balls or similar items into various positions. A number of these patents show random selection devices which select a small group of marked balls from a larger group, in order to produce a random result. See, for example, Guill U.S. Pat. No. 3,534,964, Gamble U.S. Pat. No. 4,368,887 and Salvucci U.S. Pat. No. 4,508,346. Of these, the Guill patent shows a device with an upper plenum or chamber having a series of marbles with different colors or markings, with a plurality of vertical tubes below the plenum for receiving stacks of the marbles, apparently in random fashion. The marbles fall into the vertical tubes by gravity with fewer than all of the marbles permitted to enter the tubes. Games may be played with the winner determined by the pattern of marble colors arranged in the tubes.

The Gamble patent is similar, adapted to select a small set of balls randomly from a larger population of balls.

The Salvucci patent shows a somewhat different device in which a series of balls in a holding area are propelled upwardly by a stream of air from a motor driven blower. The balls are propelled into an upper tubular column where their order of arrangement is random. In most embodiments, Salvucci discloses capturing less than all of the available balls in the column; however, in one embodiment he discloses capturing a full complement of the balls randomly in the tubular column.

SUMMARY OF THE INVENTION

The random distribution machine of this invention is adapted to distribute randomly a plurality of game pieces, some of which have markings different from the remainder. Although the device is especially suited for a game such as bingo or keno, wherein the position of various game pieces in a matrix determines whether a player wins or loses, it can also be used for other games and variations of these games, including card games such as draw poker.

The gaming device includes a housing formed of parallel plates, the spacing between which is adequate to accommodate only one width of a spherical or disc-shaped game piece, to establish a two-dimensional arrangement of the balls. The interior housing space between the two parallel plates has a circular rotatable ring which defines a chamber interior of the ring within which the game pieces reside. With the housing vertical or at least tilted upwardly, the game pieces tend to fall by gravity toward the bottom of this chamber, making contact with the rotatable ring and with a series of spaced notches or recesses in the rotatable ring, preferably U-shaped, each of which is capable of holding a game piece which falls therein.

At the top of the chamber in the housing is a game piece holding section in the shape of a display matrix, for randomly receiving the game pieces to form patterns or lines (including oblique lines) of one type of game piece, to determine whether the game has been won.

The rotatable ring is rotated, preferably by a motor, to move the game piece recesses progressively up toward the holding section or matrix. As the recesses approach an orientation where the game piece could roll and fall out of the recess, a blocking means immediately adjacent to the interior edge of the rotatable ring holds the game pieces in place. Once the blocking means has been cleared, the game piece from each recess falls into the holding section, forming a pattern with the two different colors or markings of game pieces. Preferably, the holding section or matrix is divided into a plurality of discrete columns side-by-side, with divisions between columns, so that the game pieces are stacked in equal columns side-by-side and the columns fill generally sequentially, in an orderly entertaining and aesthetically pleasing fashion. However, the matrix could be a simple rectangle or other shape, with the rounded game pieces still forming a pattern from which the determination of a winner could be made.

Also, other forms of mechanical game piece movers could be employed in lieu of the described ring; for example, a form of chain conveyor could be used, with recess-engaging or gripping elements which will pick up the game pieces in random order.

In the matrix, the entire population of game pieces preferably is included, although the matrix can hold fewer than all of the game pieces if desired for particular types of games. Preferably only two different colors or markings of pieces are included, but three or more different markings could be used for various games. The game pieces can form vertical, horizontal or diagonal lines, so as to indicate a winning matrix for a game such as bingo. More complex patterns in the matrix can be defined as winning combinations, such as squares.

The display matrix or holding section has a bottom supporting surface which is retractable, so that once the result of the game has been determined, this support can be retracted to drop all of the game pieces back into the mixing area of the chamber. This preferably is accomplished using a solenoid, although other electric releases (or even a manual release) could be employed. Similarly, the rotation of the rotatable ring employs an electric motor in a preferred embodiment, although this could also be done by hand. Further, the rotation of the ring preferably is reversible so that, once the game pieces have been dropped into the mixing area from the matrix, the ring can be turned in reverse to tumble and mix the game pieces, which during such reverse rotation cannot remain in the recesses of the ring beyond a point at which the recesses begin to become inverted; the pieces fall and tumble into a random mix.

In a variation of the gaming device, the game piece support of the matrix can be divided into separately operable gates, one for each column of the matrix. Thus, for each releasable gate, second or further chances can be given to arrange game pieces in a certain fashion in each column, and this can be accomplished by higher-stakes play at each increment. Released game pieces can be re-mixed and then brought back up into the columns or column remaining. An electric release can be provided for each gate, operable by the player to activate this mode of play.

Accordingly, in one embodiment of the present invention a random selection machine for mixing and randomly selecting and distributing game pieces into a plurality of rows and columns or otherwise into a matrix includes a housing formed of a pair of parallel plates, at least a portion of a front plate being transparent for viewing by a user. The housing space includes a chamber for game pieces, and a mechanical means for engaging and picking up game pieces randomly and moving them to an upper location. A holding section or display matrix at or near the top of the mechanical means is provided to receive game pieces which are brought up into that section by the mechanical device. The pattern of game pieces assumed in the matrix will determine whether the player has won the game.

It is therefore among the objects of the invention to provide a simple and efficient random selection device for playing a game, wherein, in a preferred embodiment, rotation of a ring in one direction will draw disc-shaped or spherical game pieces up to a holding section to form a matrix which will display a randomly distributed winning or losing pattern; and wherein rotation of the ring in a reverse direction will tumble and mix the game pieces randomly. These and other objects, advantages and features of the invention will be apparent from the following description of a preferred embodiment, considered along with the accompanying drawings.

DESCRIPTION OF PREFERRED EMBODIMENTS

Figure 1:
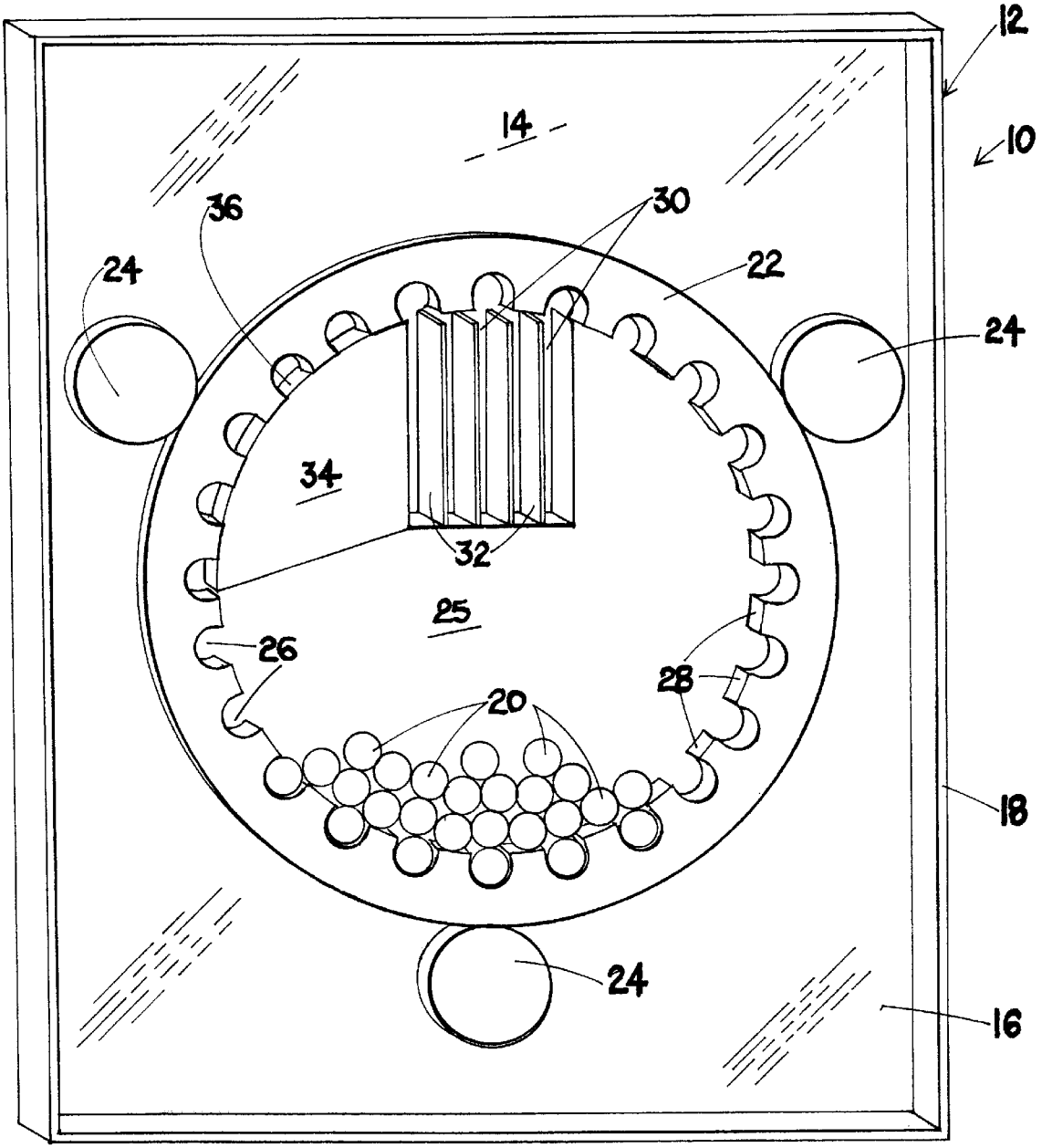
FIG. 1 is a frontal perspective view showing a game of chance device involving random selection and distribution of game pieces, in accordance with the preferred embodiment of the invention.
Figure 4:
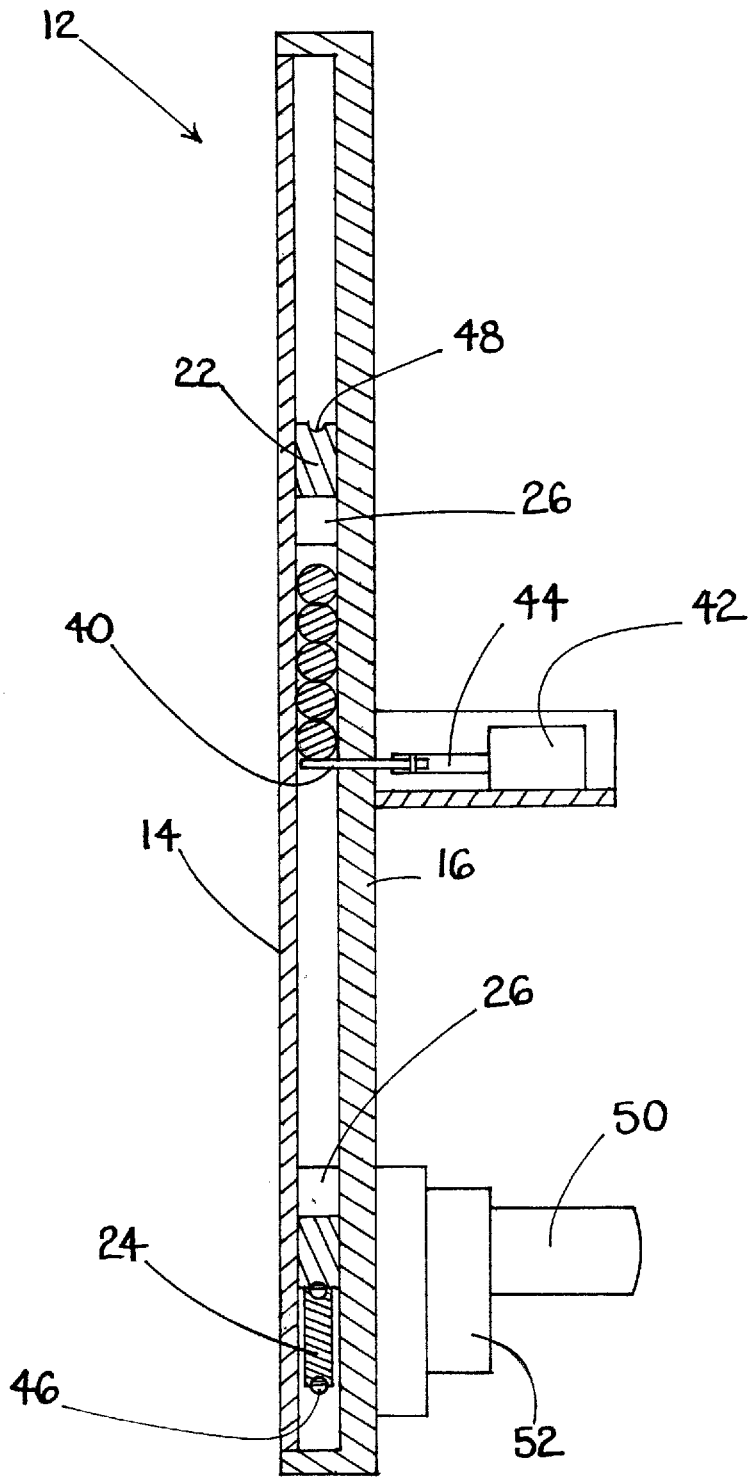
FIG. 4 is a side elevational section view of the device shown in FIG. 3, revealing a retractable support for the game pieces and showing a mechanism for rotating a ring which forms a part of the device.

FIG. 1 shows a gaming machine or device 10 which has a housing 12 including a transparent, planar front plate 14 and a parallel back plate or surface 16, visible behind the transparent plate 14 and better seen in the sectional view of FIG. 4. The plates 14 and 16 may be held together by an outer frame 18 of the housing, as indicated. It should be understood that the back plate 16 can simply comprise a flat surface, which could be a part of another structure (e.g. a wall), rather than comprising a relatively thin plate.

The plates 14 and 16 thus define a space between them, and this space is just large enough to accommodate the width of a number of game pieces 20 which are stored between the plates. These game pieces 20 may be disc-shaped, generally the shape of checkers, or they can be spheres as indicated in the drawings, thus in either event having curving sides lying generally parallel to the planes of the front and back plates 14 and 16. This is to enable the game pieces 20 to tumble and roll within the housing, so as to become capable of random distribution within the housing.

As can be seen from the drawings, there is a rotatable ring 22 also positioned between the front and back plates 14 and 16. The rotatable ring fits therein with relatively small clearance front to back, and its position is also defined by a series of bearing wheels 24, preferably three as shown, although other numbers of wheels can be employed. Two wheels positioned near the bottom end of the housing, for example, can be sufficient if the housing 12 is always held in stable position. Also, another type of ring suspension could be used.

As is appreciated from a review of the drawings, the rotatable ring, together with the front and back plates 14 and 16 of the housing, define a chamber 25 within which the game pieces 20 are contained and cannot escape. In the conditions shown in FIG. 1, all of the game pieces 20 are toward the bottom end of this game piece chamber, and several have fallen by gravity into notches or recesses 26, preferably evenly-spaced around the inner edge 28 of the ring 22 as shown. The purpose of these recesses 26 is to catch the game pieces 20 and to fill the recesses as the ring is rotated to draw the game pieces up toward an upper end of the chamber, as will be explained further below.

At the top of the chamber 25, i.e. toward the upper end of the housing 12, is a holding section 30 for game pieces, preferably in the form of a display matrix. The display matrix as illustrated is rectangular, so as to be able to hold the round game pieces 20 in an ordered array or matrix, and has column dividers 32 which enable the game pieces to stack in similar columns side-by-side (see FIG. 3). However, it is to be understood that the holding section 30 could be configured without the column dividers 32, still preferably in a rectangular shape, so that the game pieces 20 could form a different type of array, but still an ordered array defining patterns, rows, diagonal lines, etc. Even non-rectangular shapes could be used, so long as an ordered array can be formed. In the preferred embodiment the column dividers 32 are included, in a rectangular matrix.

Figure 2:
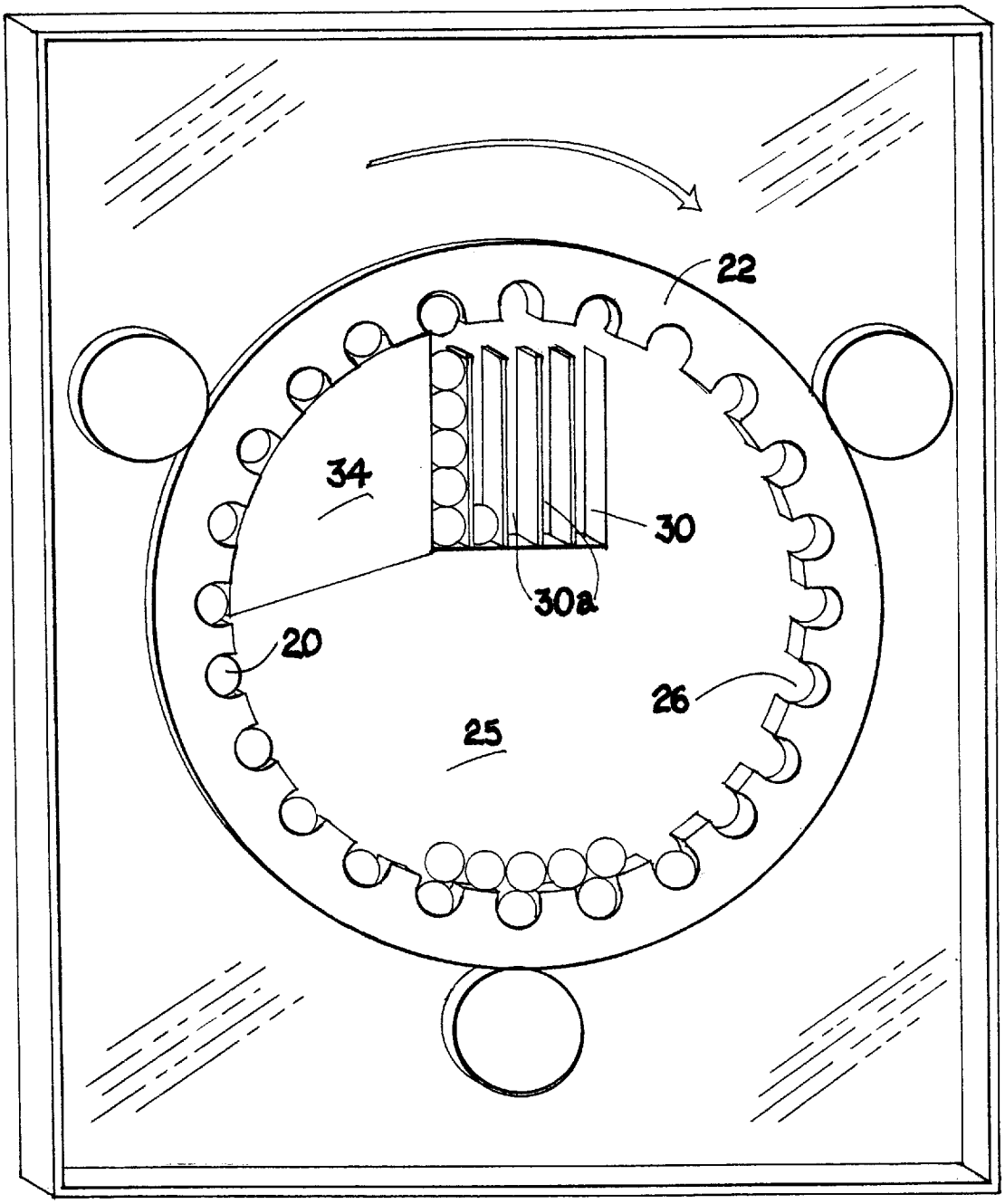
FIG. 2 is a view similar to FIG. 1, but indicating motion of the device and the stacking of game pieces in columns in a matrix.

A blocking device 34 is also positioned within the housing, between the plates 14 and 16, having a curving outer edge 36 which blocks the game pieces 20 from falling back down in the chamber when each individual recess 26 rises high enough in the chamber that a game piece 20 would otherwise fall out of the recess (see also FIG. 2). Other means for holding the pieces 20 in the recesses 26 could be used, although the blocking device 34 comprises a straightforward mechanical approach.

Figure 3:
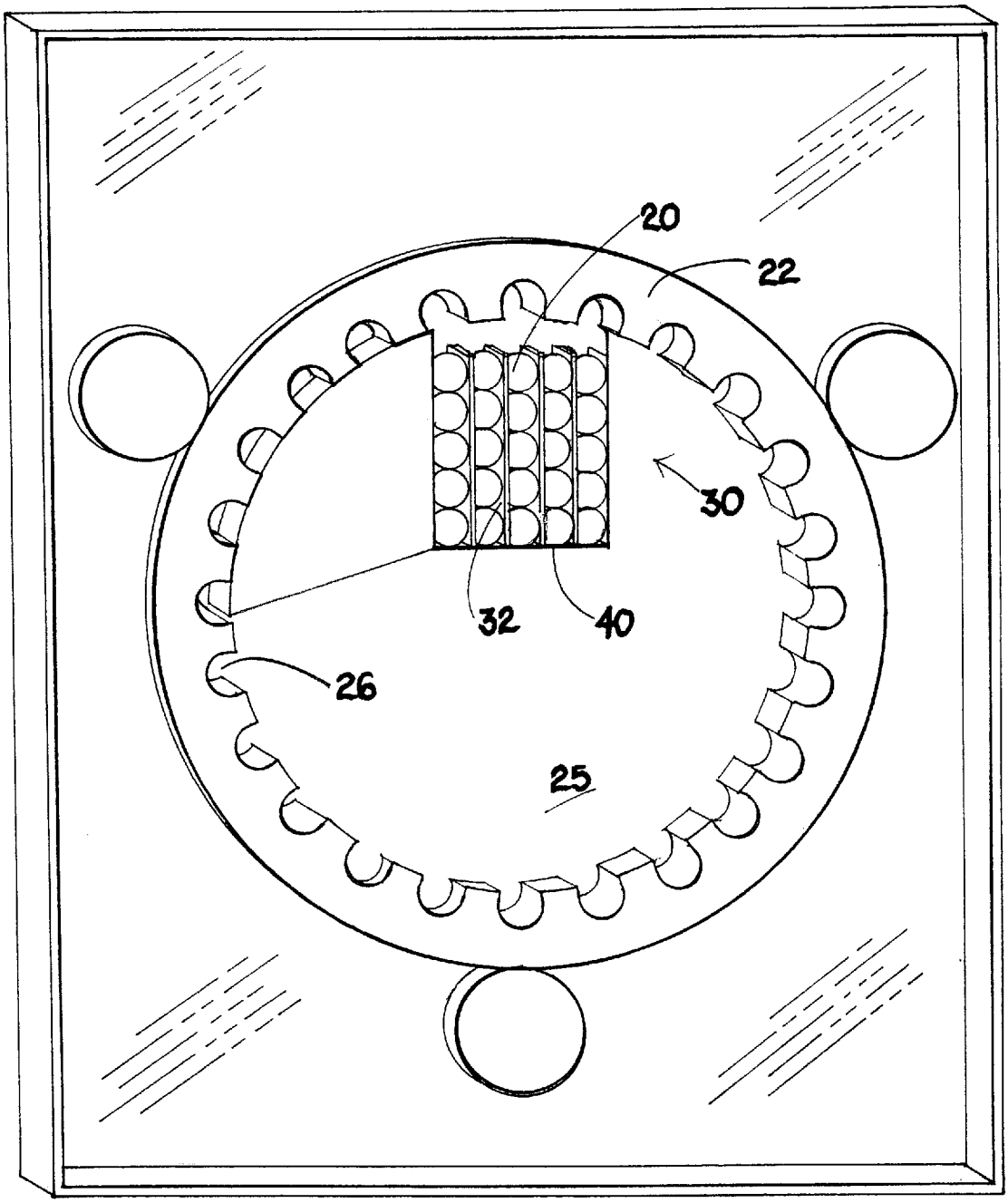
FIG. 3 is another view similar to FIG. 1, showing the device with the matrix fully composed of the game pieces, so that a pattern can be identified relative to whether a winning matrix is present.

With reference to FIGS. 1, 2 and 3, it is seen that the game pieces 20 are first contained near the bottom of the chamber 25, in a mass as indicated, having fallen there by gravity. At this point the rotatable ring 22 can be rotated in the counterclockwise direction (for the configuration shown in FIG. 1, with the block 34 at the upper left), for the purpose of tumbling and mixing the game pieces. The game pieces will fall out of the ring 22 as they reach and exceed approximately the three o'clock position, as can be envisioned from FIG. 1.

Following such tumbling/mixing as desired, the ring or wheel 22 is rotated in the clockwise direction, which causes all of the notches or recesses 26 to be successively filled by available game pieces and which causes the game pieces 20 to be drawn upwardly and around with the ring 22, being retained in the recesses in the region of the block 34 (or other retention means). When the game pieces reach the holding or display section 30, they will fill the columnar spaces 30*a* successively, from left to right, as shown in FIG. 2. As each column successively fills, the game pieces in recesses 26 will tumble over the filled columns to find the first available position of vacancy. Ultimately, all of the columns will be filled as shown in FIG. 3.

FIGS. 1, 2 and 3 show a preferred form of the game and device in which the number of game pieces is just sufficient to fill the columns 30*a* of the matrix or holding section 30. If desired, additional game pieces can be provided, and this will define a somewhat different type of game wherein, if two different colors or markings of game pieces are provided, not necessarily all game pieces of one color will assume positions in the matrix.

Figure 5:
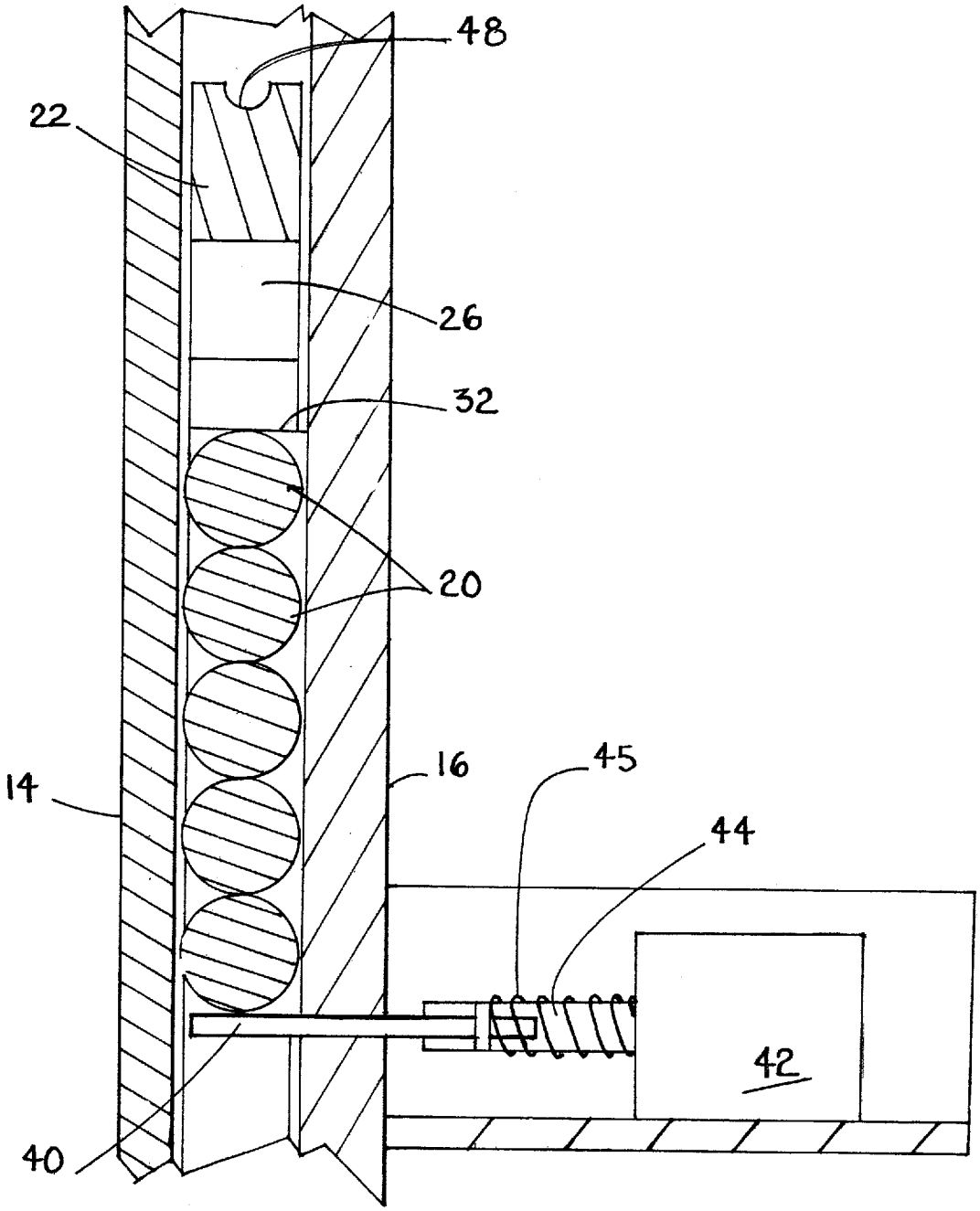
FIG. 5 is an enlarged detail view showing the retractable support for the game pieces.

As also seen in the Figures, a retractable support 40 is provided at the bottom of the display matrix or holding section 30. This allows the game pieces to be dropped back down to the bottom of the chamber 25 when a determination has been made whether the matrix 30 defines a winner, and when a new game is to be played. FIGS. 4 and 5 show in cross section an arrangement by which the support platform or gate 40 is made retractable. A solenoid 42 has a plunger 44 which draws the platform 40 back when the solenoid is energized; a spring, such as an external compression spring 45 associated with the solenoid 42, pushes the plunger 44 and platform 40 back into the position shown in FIGS. 4 and 5 when power is removed from the solenoid.

In another embodiment of the invention, not shown, the platform or gate 40 may be replaced with a plurality of separably operable individual gates, one for each column, as disclosed in my earlier U.S. Pat. No. 5,050,880, and the disclosure of that patent is incorporated herein by reference. Each individual gate can comprise a single narrow platform or retractable rod, with a separate retracting solenoid 42 provided for each column.

Figure 6:
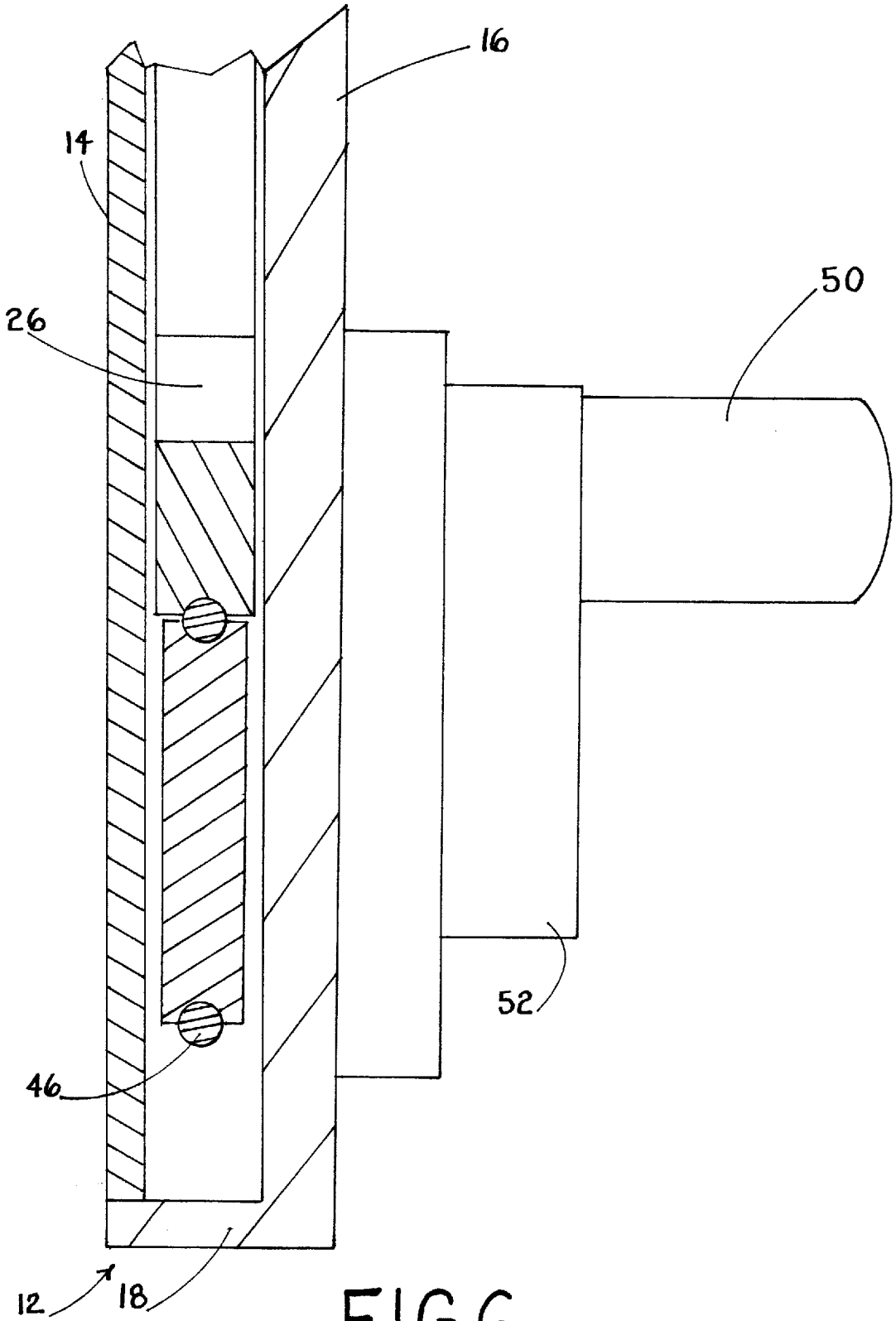
FIG. 6 is an enlarged detail view showing the driving mechanism.

FIG. 4 also shows the rotatable ring 22 and several of the notches or recesses 26. At the bottom of the rotatable ring as seen in FIGS. 4 and 6, is the bearing wheel 24, which in this embodiment is the driving wheel, since positive engagement will always be present by gravity force. The driving wheel 24 may have a rubber (or rubbery) ring 46, such as an O-ring, on its exterior for engagement with a groove 48 in the rotatable ring. Rotation of the ring in this embodiment is effected by an electric motor 50 and gear box 52, and this can be connected to a timer, reversal device, etc. for operating the rotatable ring as described above, preferably effected by placing a coin in a coin slot (not shown). The solenoid or solenoids 42 are also preferably operated by such a timing device or simple cycle controller or program which controls the cycle of play of the game; such controls for gaming devices in general are well known.

The marking differentiating two different types of game pieces 20 can be color; for example, black and white. As noted in my U.S. Pat. No. 5,050,880, in a gaming machine such as described, it is necessary to make an automatic determination as to what, if anything, the player has won. Additional plays or coins can be awarded, depending on the arrangement of game pieces in the matrix 30. In a game such as bingo, the player wins if a line of similar color is formed horizontally, vertically or diagonally. Many other games are possible wherein certain linear arrangements or patterns of the game pieces appear. For this purpose, there preferably is included in the device of the invention a series of sensors which will determine which type of game piece is contained at each position in the matrix. One embodiment of such a sensing apparatus is fully described in U.S. Pat. No. 5,050,880, incorporated by reference herein, and thus no detailed description of such a sensing device is repeated here.

Figure 7:
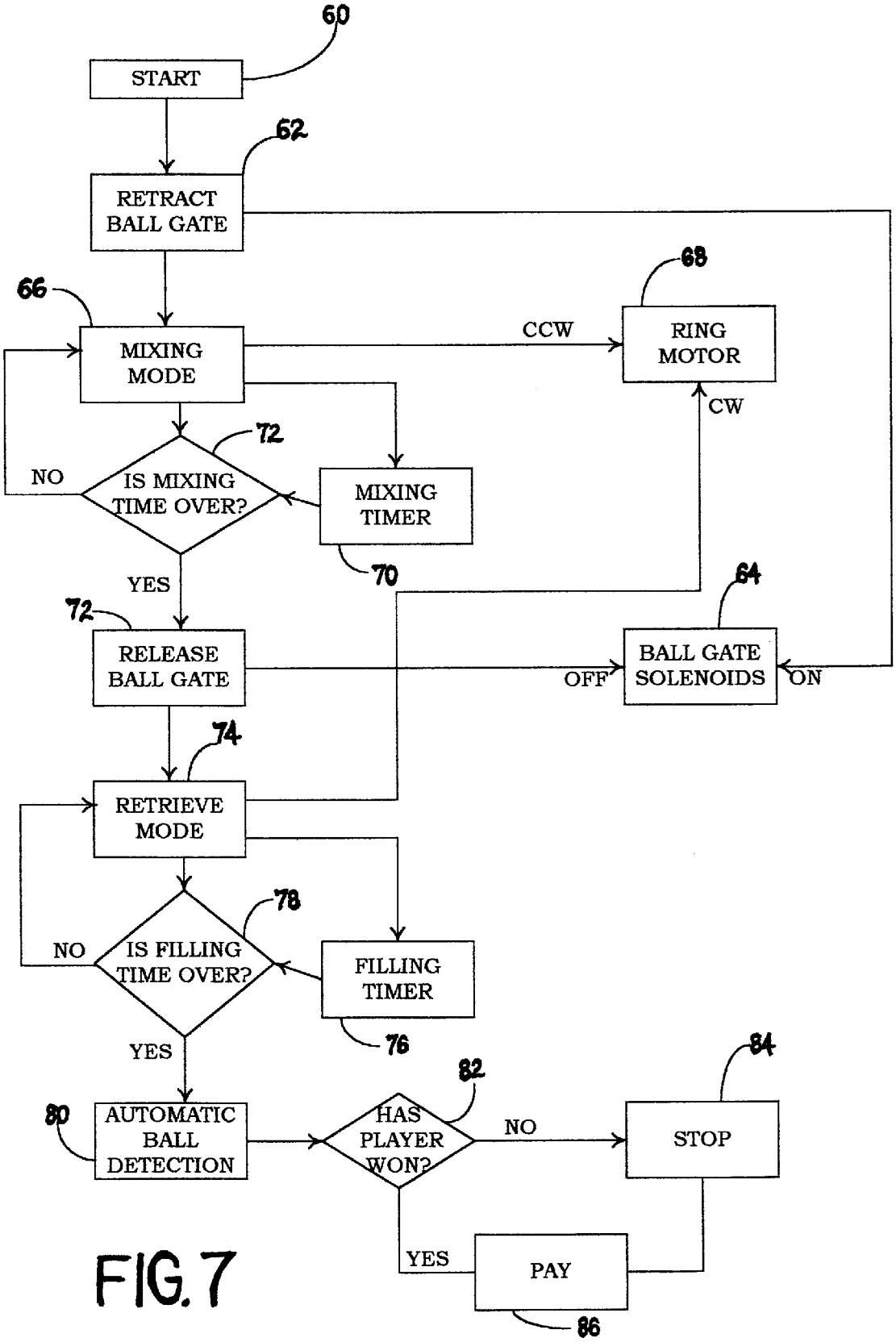
FIG. 7 is a simplified flow chart indicating the operation of the gaming device of the invention.

FIG. 7 shows the operation of the gaming machine 10 schematically, in the form of a flow chart. The box 60 indicates the start of the game, which may be effected by the dropping of a coin into the machine. The ball gate(s) or platform 40 is first retracted, as noted at 62. The diagram indicates that this involves turning the ball gate solenoid or solenoids "on" at the block 64. Further, the retraction of the ball gate initiates the mixing mode as indicated in the block 66 of the drawing.

In the mixing mode the ring motor 50 is energized in the counter-clockwise (CCW) direction as noted in the block 68, for a limited period of time as controlled by a mixing timer indicated in the block 70. The decision block 72 details that when the mixing duration is over, the ball gate or gates are to be released (block 72), i.e. the solenoid is de-energized or turned "off" so that the gates or platform 40 return to the position shown in FIGS. 1–5.

Next the retrieve mode is initiated (block 74), which energizes the ring motor in the clockwise (CW) direction, indicated at the block 68. The retrieve mode also starts a timing cycle by a filling timer indicated in the block 76, which is merely a timing counter which may be set to a known, adequate period of time for all game pieces to have been brought up to the matrix or holding section 30. Other arrangements can be used if desired, such as making the determination by photocells, which can be the same photocells as used in determining which color is in each position as noted above, so that the ring motor can be turned off as soon as it is confirmed that all positions are filled. However, in the embodiment shown in FIG. 7, a simple timing cycle is used, and when the prescribed duration of time for clockwise rotation of the ring has expired (block 78), the rotation of the ring or wheel 22 is stopped.

At this point automatic game piece color detection is initiated, as noted in the block 80. A determination is made, by positions of the different colors (or other markings) of game pieces, whether the player has won (see decision block 82). If not, the game is stopped as at 84; if so, the player is paid, as noted at 86. There can be different levels of winning arrangements; for example, a line of three or four consecutive black pieces can pay the player lesser amounts than a line of five black pieces.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A game of chance device with random selection and distribution of game pieces, comprising:

a plurality of game pieces, the game pieces having means enabling visually discerning between at least a first type and a second type, a housing containing the game pieces, including a pair of essentially planar walls, one of them being transparent at least in part, spaced apart a distance only to allow a two-dimensional positional arrangement of the game pieces in the housing such that all game pieces remain generally in a common plane which is oriented non-horizontally to define a top and a bottom end of the housing, the game pieces being generally rounded so as to have curving edges lying in said common plane, a rotatable ring in the housing, positioned generally in said common plane with the game pieces and being rotatable about an axis normal to the common plane, the rotatable ring being positioned so as to confine the game pieces to an area defined interior of an inner edge of the rotatable ring, a plurality of spaced apart game piece-receiving recesses formed in the inner edge of the rotatable ring, each sized to receive a game piece falling therein by gravity, means for rotating the rotatable ring in a first direction, to pick up game pieces in the recesses in the edge of the ring toward the bottom end of the housing, and to move the game pieces along with the ring toward the top end of the housing, retaining means extending through a limited arc of the rotatable ring, for retaining game pieces against falling out of the recesses in a portion of the housing where the recesses begin to be oriented downwardly as the ring rotates such that the game pieces would fall out of the recesses at said limited arc but for the retaining means, and a display matrix in the housing adjacent to and immediately below the rotatable ring and adjacent to the retaining means, generally at the top end of the housing, having means for receiving the game pieces as the ring rotates to move the game pieces past the retaining means to expose the recesses to the display matrix such that the game pieces fall into the display matrix, whereby the game pieces fill the display matrix and assume an ordered array in the display matrix, so that random patterns in arrays of the game pieces occur and can be identified by a user.

2. The game of chance device as defined in claim 1, wherein the game pieces are spherical.

3. The game of chance device as defined in claim 1, wherein the game pieces are disc-shaped.

4. The game of chance device as defined in claim 1, wherein the display matrix comprises a series of storage columns with means separating the columns from one another, formed in a generally rectangular recess, so that the game pieces successively fill the storage columns as the game pieces are brought to the vacant storage columns by the rotatable ring.

5. The game of chance device as defined in claim 4, wherein the display matrix includes, at the bottom of the series of storage columns, a supporting surface with means for retracting and replacing the supporting surface when desired, to release the game pieces and allow them to drop out of the display matrix and down within the area defined interior of the rotatable ring.

6. The game of chance device as defined in claim 5, wherein the supporting surface comprises an individually operable support gate at each column.

7. The game of chance device as defined in claim 1, wherein the display matrix includes, at a bottom side of the matrix, a supporting surface with means for retracting and replacing the supporting surface when desired, to release the game pieces and allow them to drop out of the display matrix and down within the area defined interior of the rotatable ring.

8. The game of chance device as defined in claim 7, further including means for rotating the rotatable ring in a second direction, opposite said first direction, for tumbling and mixing the game pieces in the housing.

9. The game of chance device as defined in claim 1, wherein the means for rotating the rotatable ring comprises a motor and bearing means supporting the rotatable ring for rotation in the housing.

10. The game of chance device as defined in claim 1, wherein the game piece-receiving recesses comprise generally U-shaped openings formed in the inner edge of the rotatable ring.

11. The game of chance device as defined in claim 1, further including means for rotating the rotatable ring in a second direction, opposite said first direction, for tumbling and mixing the game pieces in the housing.

12. The game of chance device as defined in claim 1, further including sensor means for automatically determining which type of game piece, of said first type or second type, is present at each of a series of positions in the display matrix, so that the determination of whether or not a winning matrix of game pieces is present can be accomplished automatically.

13. The game of chance device of claim 1, wherein the retaining means comprises a blocking means positioned alongside the inner edge of the rotatable ring and extending through said limited arc along the rotatable ring, for blocking game pieces from falling out of the recesses along said limited arc.

14. A game of chance device with random distribution of game pieces, comprising:

a multiplicity of game pieces, the game pieces having means enabling visually discerning between a first type and a second type, a housing containing the game pieces, including a pair of essentially planar walls, one of them transparent, spaced apart a distance only to allow a two-dimensional positional arrangement of the game pieces in the housing such that all game pieces remain generally in a common plane which is oriented non-horizontally to define a top and a bottom end of the housing, the housing thus being positioned so that gravity acts on the game pieces tending to cause the game pieces to fall toward and accumulate near the bottom end of the housing, the game pieces being generally rounded so as to have curving edges lying in said common plane, mechanical means in the housing for engaging game pieces randomly near the bottom end of the housing and for moving the game pieces in random order up toward the top end of the housing, and a display matrix in the housing, located toward the top end of the housing, having means for receiving the game pieces as the mechanical means moves the game pieces up to a position adjacent to the display matrix such that the game pieces fall into the display matrix, in adjacent juxtaposed columns so as to form rows and columns of said first and second types of game pieces, whereby the game pieces fill the display matrix and assume an ordered array in the display matrix, so that random patterns in arrays of the first and second game pieces occur and can be identified by a user.

15. The game of chance device as defined in claim 14, wherein the mechanical means in the housing includes a rotatable ring with means for engaging and holding the game pieces as the rotatable ring is rotated, to move the pieces from the bottom end of the housing toward the top end of the housing, and including means for delivering the game pieces from the rotatable ring into the display matrix as the game pieces reach the display matrix.

* * * * *